US009655460B1

(12) United States Patent
McClinton

(10) Patent No.: US 9,655,460 B1
(45) Date of Patent: May 23, 2017

(54) DUAL PURPOSE PLATE WITH REMOVABLE BEVERAGE CONTAINER

(71) Applicant: Raymond McClinton, Homewood, IL (US)

(72) Inventor: Raymond McClinton, Homewood, IL (US)

( * ) Notice: Subject to any disclaimer, the term of this patent is extended or adjusted under 35 U.S.C. 154(b) by 0 days.

(21) Appl. No.: 14/840,023

(22) Filed: Aug. 30, 2015

Related U.S. Application Data

(63) Continuation-in-part of application No. 13/998,938, filed on Dec. 26, 2013, now abandoned.

(60) Provisional application No. 61/834,173, filed on Jun. 12, 2013.

(51) Int. Cl.
*A47G 19/00* (2006.01)
*A47G 19/02* (2006.01)
*A47G 19/22* (2006.01)

(52) U.S. Cl.
CPC ..... *A47G 19/02* (2013.01); *A47G 19/2205* (2013.01)

(58) Field of Classification Search
CPC ... B65D 21/0202; B65D 1/30; B65D 21/0204
USPC ..... 206/561; 215/316, 317, 321, 339, 353, 215/376; 220/212, 23.86, 315, 780, 796, 220/797, 798
See application file for complete search history.

(56) References Cited

U.S. PATENT DOCUMENTS 4,732,274 A * 3/1988 Bouton ..... A47G 19/065 206/1.7
4,938,373 A * 7/1990 McKee ..... A47G 19/065 215/376
6,062,418 A * 5/2000 Rathjen ..... A47G 19/065 220/23.83
7,891,514 B1 * 2/2011 Walsh ..... B65D 43/0212 220/4.21

* cited by examiner

*Primary Examiner* — Fenn Mathew
*Assistant Examiner* — Kevin Castillo

(57) ABSTRACT

A plate with an aperture or opening located within the perimeter of the plate is adapted to receive a beverage container thereby allowing a user to hold both a plate and a beverage in one hand. A raised exterior perimeter wall and a raised interior retaining wall are configured to contain food or other articles on the plate and to avoid spills and leakages while being held by a user. A plurality of raised interior segmenting walls allow a user to separate articles of food, condiments, or other items located on the surface of the plate.

1 Claim, 5 Drawing Sheets

DUAL PURPOSE PLATE WITH REMOVABLE BEVERAGE CONTAINER

RELATED APPLICATION

This application is a continuation-in-part of application Ser. No. 13/998,938 filed Dec. 26, 2013, which claims the benefit of Provisional Application No. 61/834,173 filed Sep. 9, 2013, the subject matter of which applications is incorporated herein by reference.

BACKGROUND OF THE INVENTION

Field of the Invention

The present invention relates to the field food and beverage serving devices and more particularly to dual purpose food plates with removable beverage containers.

Description of the Prior Art

Food and beverages are often served at social and business gatherings such as sporting events, conferences, festivals, barbecues, and the like. Often times there are not enough tables or horizontal surfaces for a person to properly eat from a plate of food while holding a beverage leading to spills and the uncomfortable consumption of the food and beverage.

Numerous attempts have been made in the art to overcome this dilemma. For example; U.S. Pat. Pub. No. 2011/0095032 published Apr. 28, 2011 by Evans describes a party plate with an aperture in the center of the plate to receive a beverage container holder. Evans also describes a series of perforations located within the beverage container. One of the disadvantages of the Evans plate is that an aperture in the center of the plate allows food and other items located on the plate to escape through the aperture when the beverage container is not attached. This is an inconvenient feature and makes this particular plate unusable without the required beverage container attached. Additionally, even with the beverage container attached, users may not want liquids such as gravy to run through the perforations in the container and onto their beverages or other items which may be placed within the beverage holder.

U.S. Pat. No. 5,292,028, issued Mar. 8, 1994 to Patterson, describes a plate with a glass holder formed on its bottom, where the plate includes a plate holder adapted to hold a separate disposable plate. A problem with this invention is that the glass holder on the bottom side is not level making it difficult to set down on a flat surface such as a table.

U.S. Pat. No. 4,461,396, issued Jul. 24, 1984 to Harper, discloses a plate having a recess for the lower end of a glass in its upper surface allowing a user to insert their thumb into the recess to hold the plate. A disadvantage of this invention is that a movement or relief of the thumb pressure by the user may allow the glass to become dislodged and spill outside the glass.

Although many attempts have been made in art to overcome the challenge of holding both a food plate and a beverage in one hand, none of the related inventions have overcome all of the drawbacks and disadvantages outlined herein. What is therefore needed in the field is a sturdy, dual purpose food plate capable of being secured as needed to a beverage and article container and allowing a user to place the plate onto a flat surface if available, or, to hold the plate with container in one hand without fear of spills or leakages.

SUMMARY OF THE INVENTION

The present invention comprises improved dual purpose plates with removable beverage containers which may be used in a wide variety of social and dining environments. It is an object of the invention to provide a plate with an aperture or opening located within the perimeter of the plate adapted to receive a beverage container thereby allowing a user to hold both a plate and a beverage in one hand.

It is a further an object of the the invention to provide a plate with a raised exterior perimeter wall and a raised interior retaining wall configured to contain food or other articles on the plate and to avoid spills and leakages while being held by a user.

It is yet a further object of the invention to provide a plurality of raised interior segmenting walls to allow a user to separate articles of food, condiments, or other items located on the surface of the plate.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New improved plates with removable beverage containers are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
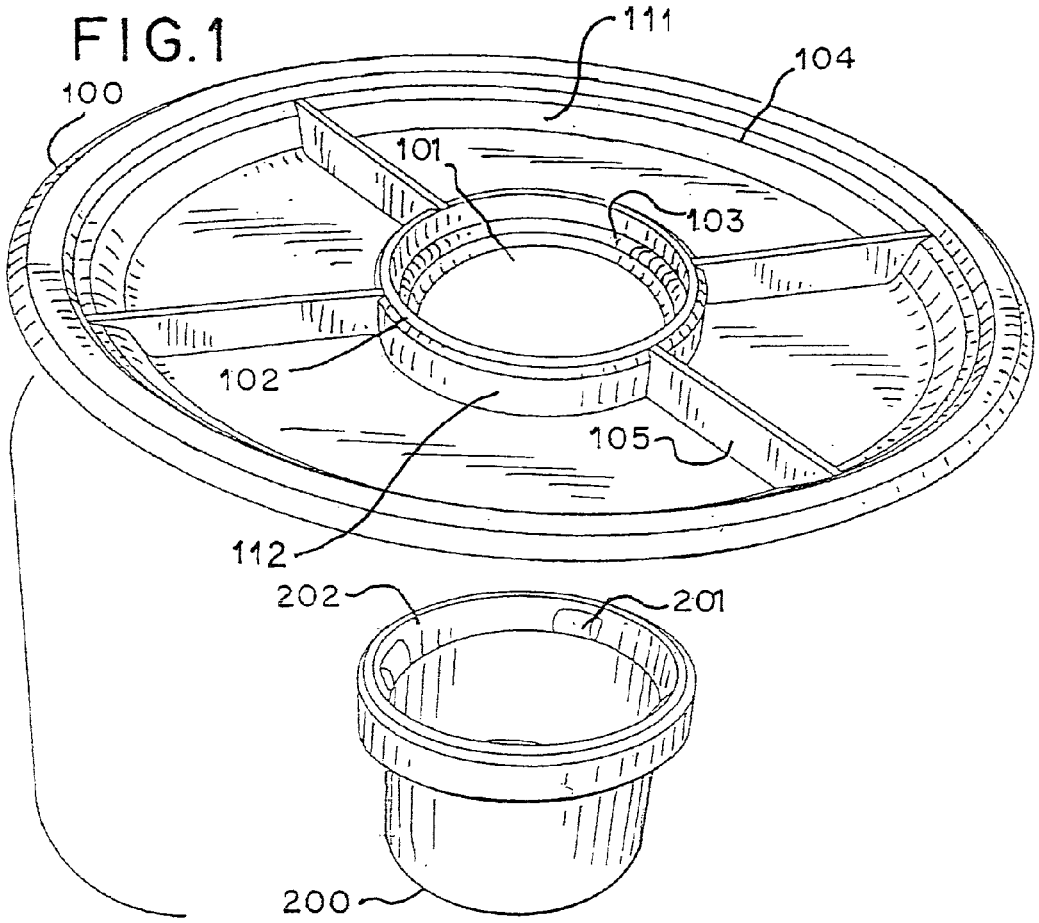
FIG. 1 shows a 3D perspective view of an example of an improved plate with a removable beverage container separated from said plate.

As perhaps best shown by FIG. 1, an example of an improved plate 100 and beverage container 200 is provided. A plate 100 as discussed herein may be of an oval design, a round circular design, a square design, a hexagonal design, or any suitable design or shape for plates used to serve food. In preferred embodiments, the plate 100 is generally an oval or round shape. In some embodiments, the plate 100 and beverage container 200 may be made from plastic such as recycled plastic including rPET, PET, PETE, PETG, etc. and the like. In some further embodiments, the plate 100 and beverage container 200 may be made from biodegradable and compostable material such as bamboo, bagasse, etc. and the like.

In preferred embodiments, the plate 100 comprises at least one opening or aperture 101 configured to receive a beverage container 200. In the example shown by FIG. 1, the aperture 101 is substantially located at the center of plate 100. In alternative embodiments, the aperture 101 may be located off-center or in close proximity to the perimeter of the plate 100. The plate 100 comprises a raised perimeter wall 104 with a height of between 0.5 inches to 1.75 inches. The raised perimeter wall 104 is configured to hold food and other articles within the plate 100 and to avoid spills and leakages as the plate 100 may be moved about from time to time. The plate 100 further comprises a raised interior retaining wall 102 surrounding the aperture 101 with a height of between 0.5 inches to 1.75 inches. The retaining wall 102 is generally configured to hold food and other articles within the plate 100 and to avoid spills and leakages as the plate 100 may be moved about from time to time.

Still referring to FIG. 1, a plurality of raised interior segmenting walls 105 may extend out radially from the interior retaining wall 102 to the exterior perimeter wall 104 on plate 100. The raised interior segmenting walls 105 may have a height of between 0.5 inches to 1.5 inches and are generally configured to separate food, condiments, or other articles placed on the plate 100.

An example of a beverage container 200 is further provided in FIG. 1. A beverage container 200 is configured to receive a beverage such as a glass, cup, bottle, or can but may also be used to store other items such as condiments, dipping sauce, napkins, food, and the like. In some embodiments, a beverage container 200 comprises a container rim 202 which may have an exterior wall configured to fit within the aperture 101 of plate 100. In some embodiments, one or more male attachment members 201*a*, 201*b*, 201*c*, 201*d* may be located on the beverage container rim 202. The male attachment members 201*a*, 201*b*, 201*c*, 201*d* are configured to be placed within the recessed interior female groove 103 which may be located within the interior retaining wall 102 of the plate 100 in some embodiments. The connection between the male attachment members and female groove 103 is one means to allow beverage container 200 to be removably connected to plate 100 using a tongue-in-groove style of connection. In some embodiments, two or more male attachment members are located on the interior (i.e. facing the center opening) of the beverage container 200. In some alternative embodiments, a single male lip or attachment ring may be located on the rim 202 of beverage container 200. In general, the male attachment members protrude slightly out and away from container rim 202 as shown by the figures. It should be noted that the present invention includes embodiments wherein the beverage container 200 is removably attached to the improved plate 100 using friction fitting and without the use of male or female members (see additional figures and description).

Figure 2:
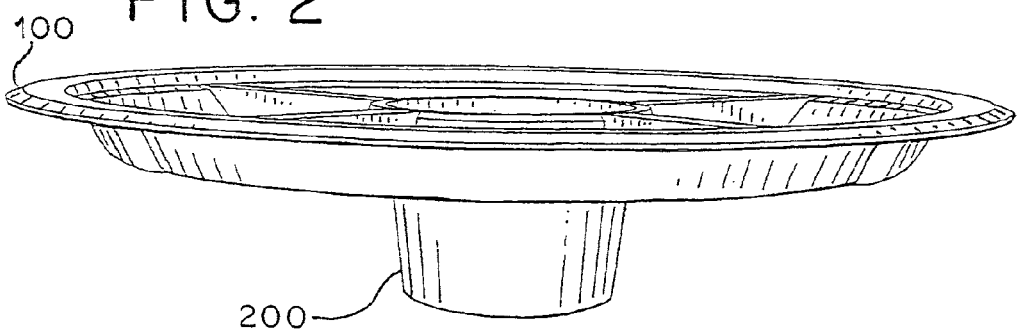
FIG. 2 illustrates a side view showing an example of an improved plate connected to a beverage container.

Now, referring to FIG. 2, a side view of a plate 100 and beverage container 200 is provided. In this example, beverage container 200 is securely connected to plate 100 through a tongue-in-groove style connection with a plurality of male attachment members (not shown) placed within a female groove or female openings located within a plate aperture. By slightly squeezing the upper portion of beverage container 200, a user may disengage male attachment members from the female groove 103 thereby removing the beverage container 200 from plate 100.

Figure 3:
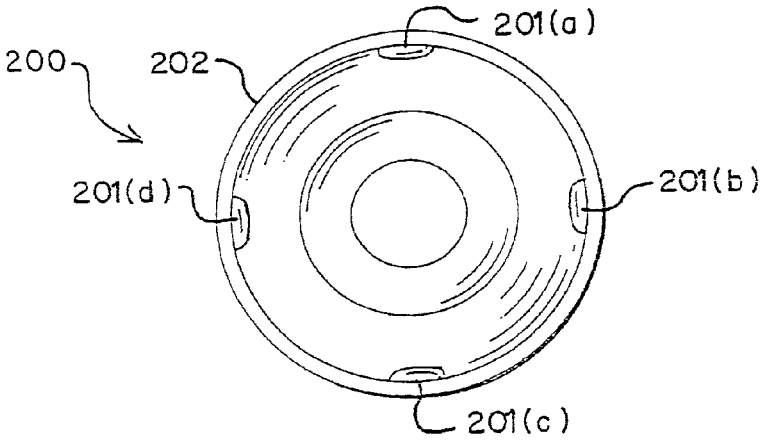
FIG. 3 shows a top down view of an example of beverage container.

As shown by FIG. 3, a top down view of an example of a beverage container 200 is provided. In this example, the beverage container 200 has an outer container rim 202 which may be a single layer of material bent or folded over onto itself to provide greater strength and support for the container 200 as it is connected to the plate 100. In some embodiments, a plurality of male attachment members protrude from the rim 202 inwardly towards the center of the container 200. In the example shown by FIG. 3, four male attachment members 201*a*, 201*b*, 201*c*, 201*d* are located on the container rim 202. In some embodiments, zero, one, two, three, four, five, six, seven, eight, or any number of suitable male attachment members may be located on the container rim 202. In some alternative embodiments, a single male lip located around the interior or exterior of the container rim 202 may be used instead of individual male attachment members 107 to secure the beverage container 200 to the plate 100.

Figure 4:
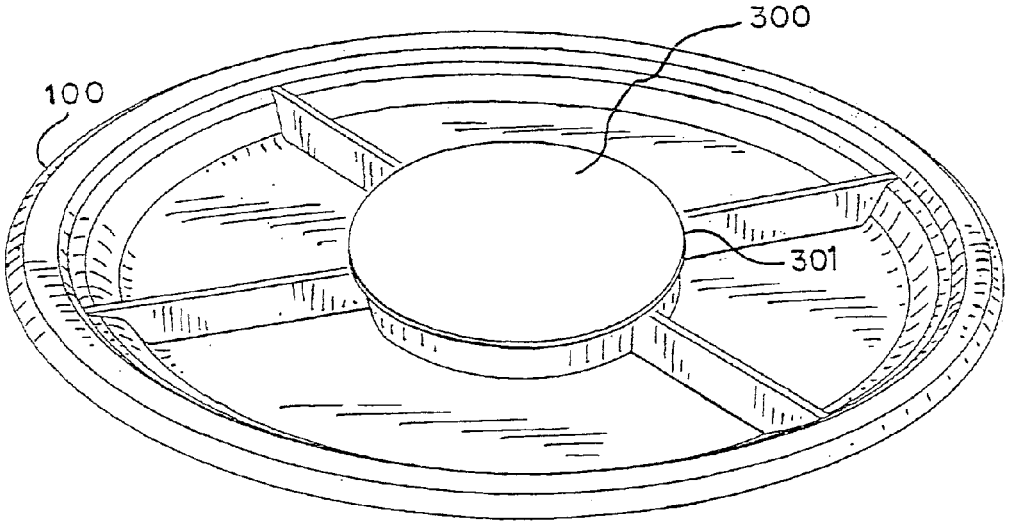
FIG. 4 illustrates an example of an improved plate with a removable cap covering the aperture of the improved plate.

FIG. 4 provides an alternative embodiment wherein a plate 100 is shown with a removable aperture cap 300. The removable aperture cap 300 may be temporarily placed over the top of the plate aperture 101. The cap 300 may be made of plastic or any suitable material. The cap 300 may, in some embodiments, have raised retaining walls 301 located along the perimeter edge of the cap and may even have a recessed valley located at the center of the cap 300 thereby allowing a user to place dipping sauce, salsa, condiments, or other articles within the center of the cap 300.

Figure 5A:
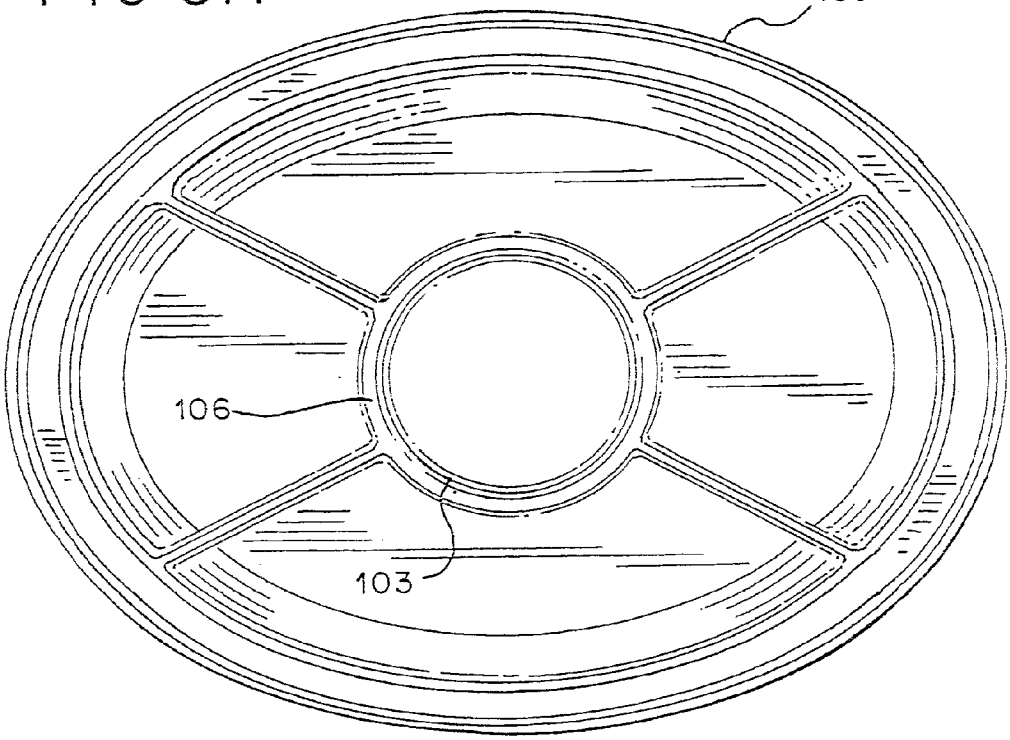
FIG. 5 shows an example of a plate from a bottom view perspective (5A) and a plate with beverage holder from a side cut-away view perspective (5B). Measurements shown are meant as an illustrative example of some embodiments only and should not necessarily be used to limit the scope of the invention.
Figure 5B:
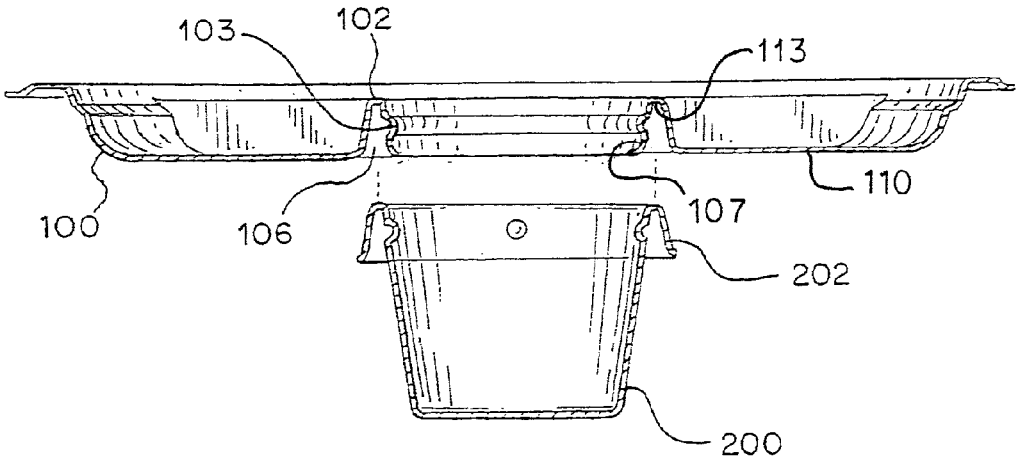

Now referring to FIG. 5, one example of a plate 100 and beverage holder 200 is provided. FIG. 5A shows a bottom view of a plate 100 while FIG. 5B shows a side cut away view of a plate 100 with beverage container 200. In some embodiments, the bottom of the plate 100 comprises a container channel 106 located around the aperture 101. The container channel 106 is configured to receive the container rim 202 of the container. The container channel 106 has an interior wall and an exterior wall and is adapted to receive one or more male attachment members 107. In some preferred embodiments, a recessed interior female groove 103 may be located on the interior wall of channel 106 proving a means to connect plate 100 to the rim 202 of beverage container 200. FIG. 5B shows a side cut away view of plate 100 with container channel 106 wherein the interior container channel 106 of this particular embodiment comprises a recessed female groove 103 on its interior wall. In some alternative embodiments, female groove 103 may be located on the exterior wall of container channel 106 or may not be present at all. An example of a beverage container 200 is shown below and not attached to the interior channel 106 of plate 100. Measurements provided are Intended as an example only for some embodiments.

Figure 6:
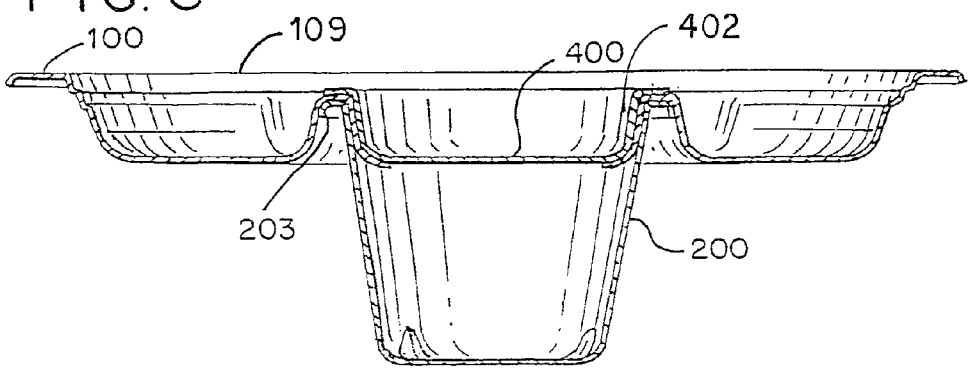
FIG. 6 shows a transparent side view of one example of a plate removably connected to a beverage container through a friction connection.
Figure 7:
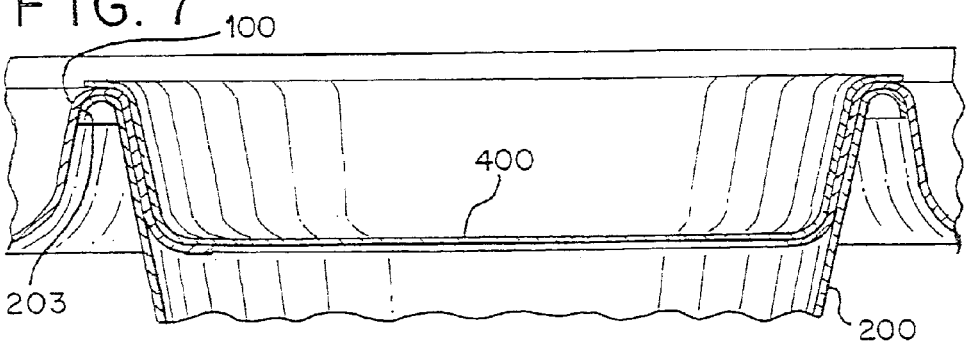
FIG. 7 shows a close-up transparent side view of one example of a plate removably connected to a beverage container through a friction connection.

As perhaps best shown by FIGS. 6 and 7, the improved plate 100 may preferably be removably connected to a beverage container 200 through a friction fit connection and without male attachment members. In this embodiment, the winged rim 203 of the container is configured with a diameter substantially the same the aperture of the plate 100. The plastic or slightly flexible material of the beverage container rim 202 allows it to be compressed and inserted into the container receptacle aperture 101. Because both the diameters of the aperture 101 and container rim 203 are substantially similar (e.g. within 0 25 inches of each other), frictional forces are created between the rim 203 and interior wall of the plate's aperture 101 thereby connecting the two pieces together also known as a "friction fit".

Figure 8:
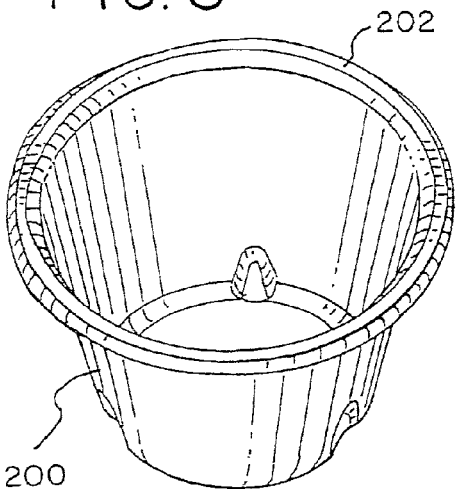
FIG. 8 shows a 3D perspective view of an example of a beverage container without male attachment members.
Figure 9:
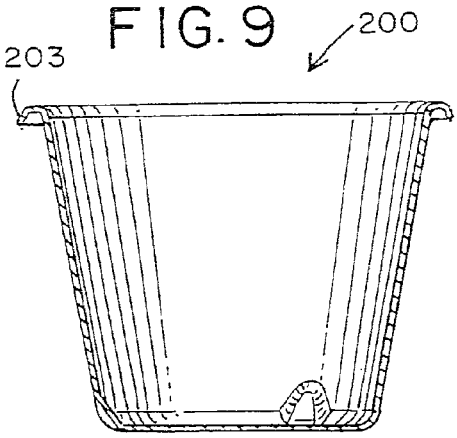
FIG. 9 shows a partial side cross section view of an example of a beverage container with a winged rim.

Referring now to FIGS. 8 and 9, in some embodiments the beverage container 200 comprises a container rim 202 which does not include any male or female attachment members. In some embodiments, the container rim 202 may have a winged rim section 203 which is flexible in nature allowing it to be slightly compressed and inserted into the aperture 101 of plate 100 forming a friction fit connection.

Figure 10:
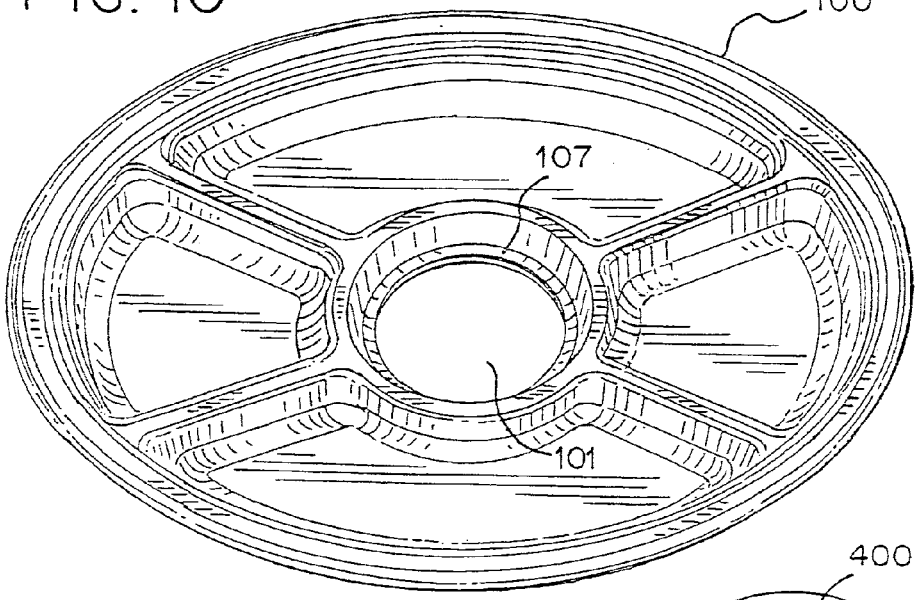
FIG. 10 shows a 3D view of one example of a plate with a support lip.

FIG. 10 shows a 3D view of one example of a plate with an optional support lip 107 located around the internal perimeter of the plate aperture 101. The support lip is configured to generally support a beverage container 200 or dipping container 400 when removably connected to the plate 100.

Figure 11:
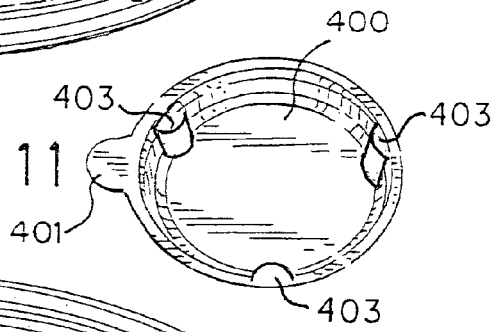
FIG. 11 shows a 3D view of an example of a dipping container with a dipping container tab.
Figure 12:
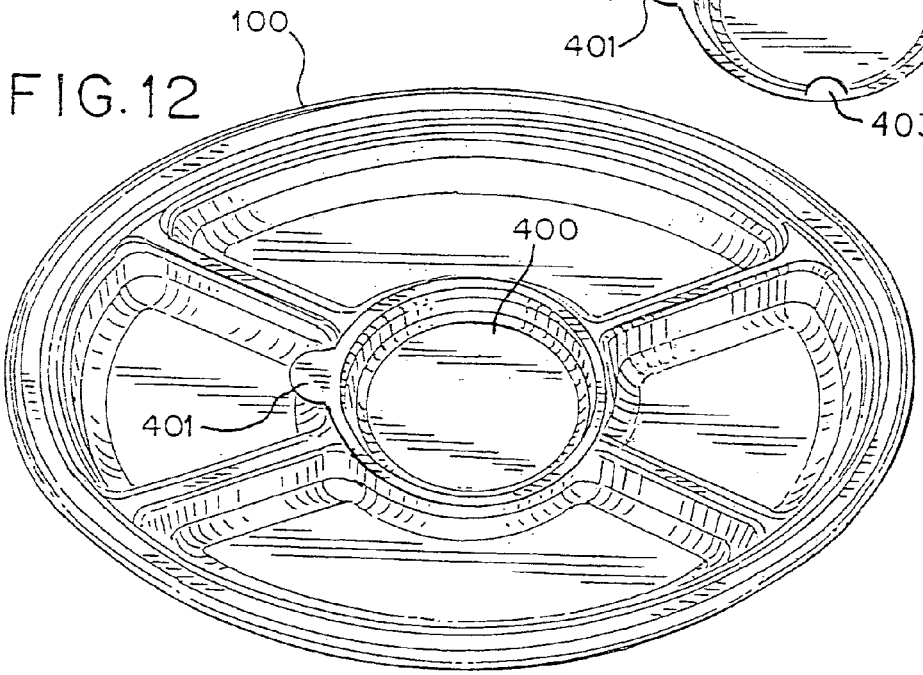
FIG. 12 shows a 3D view of an example of a dipping container with a dipping container tab removably connected to a plate.

FIGS. 11 and 12 show one example of an optional embodiment wherein the plate 100 is configured to receive a dipping container 400 for condiments, sauces, and other suitable material. The dipping container 400 may comprise one or more dipping container tabs 401. Such tab or tabs allow a user to easily remove the container 400 from within the aperture 101 of the plate 100.

Advantages of the Invention

The present invention offers many advantages to other plates known in the art. Perhaps most importantly, the plate 100 and beverage container 200 described herein may be used for dual purposes. For example, in preferred embodiments, the plate 100 is constructed with a substantially flat or planner bottom allowing it to be placed onto a table while the interior retaining wall 102 prevents food or articles from spilling or leaking out of the plate through the aperture 101. By connecting a beverage container 200 to the plate's channel 106 located on its bottom side, a user can hold both the plate 100 and a beverage within the beverage container 200 with a single hand without fear of spills or leakages from the plate 100 into the container 200. Therefore, the invention as described herein may serve dual purposes as both a traditional serving plate and as a single handed plate 100 with beverage container 200. An additional advantage of the plate 100 is the plurality of interior segmenting walls 105. The interior segmenting walls 105 prevent the spread or leakage of food or other articles from one area of the plate 100 into another area. Finally, the plate 100 and beverage container 200 may be made from strong, sturdy materials allowing a user to comfortable hold the plate 100 with a beverage in one hand in a variety of locations such as a conferences, sporting events, or barbecues. In preferred embodiments, the slightly tapered edge of the beverage container 200 allows the container 200 and plate 100 to be placed within a cup holder found on the armrest of many portable lawn chairs offering a secure location for a user to place the plate 100 and enjoy their food and beverages in a variety of locations.

The preferred embodiment of the present invention is a multi-functional system including a plate 100 and a beverage container 200 and a dipping container 400.

The plate 100 is formed with a top having a radial exterior upper surface 109. The radially exterior upper surface has a periphery in an annular configuration, the plate formed with a centrally located circular aperture 101. The plate is formed with a bottom having an annular lower surface 110 located radially between the upper surface and the circular aperture. The lower surface has upstanding side walls 111, 112 creating a frusto-conical cross sectional configuration surrounding the central aperture. The lower surface and upstanding side walls form food-receiving regions. Segmenting walls 105 extend radially between the side walls separating the food-receiving regions into separate sections.

A first connector 114 is formed in an inverted V-shaped configuration between the food-receiving regions and the circular aperture. The first connector has a first leg and a second leg. The first leg is in a planar configuration at an acute negative angle with respect to a vertical bisector between the first and second legs. The second leg is formed with an annular concave recess 103 and an annular convex recess 107. The first connector is fabricated integrally with the food receiving regions.

The beverage container 200 is formed with a closed bottom and an open top and a cylindrical side wall. The beverage container is adapted to removably receive a beverage. A second connector 202 is formed with an inverted J-shaped configuration fabricated integrally with the open top of the beverage container. The second connector is inserted upwardly into the first connector. Four circumferentially spaced male attachment members 107 project inwardly from the second connector. The four circumferentially spaced male attachment members are removably positionable in the concave annular recess facilitating separable coupling the beverage container and the plate. The bottom of the beverage container extends beneath the plate to facilitate handling.

The dipping container 400 is formed with a closed bottom and an open top cylindrical and a side wall. The dipping container is adapted to container a consumable dip. A third inverted connector 402 is formed integrally with the open top of the dipping container. The third connector is formed in an inverted L-shaped configuration with an angled single leg and an upper ledge. The third connector is positionable over the first inverted V-shaped connector facilitating coupling the dipping container to the plate due to gravity. The angled single leg has three circumferentially spaced male attachment members 403 projecting outwardly from the third connector. The three circumferentially male attachment members are positionable in the convex annular convex recess 107 to facilitate removable coupling of the dipping container to the plate. The concave recess 103 and the convex recess 107 are closely spaced elevationally to form an S-shaped cross sectional configuration. In this manner, the first V-shaped connector has diverging legs adapted to move together towards and away from an imaginary vertical center line upon the application of an outside force and to return to a rest position upon removal of the outside force. Moving of the diverging legs functions in holding together the beverage container and the plate. Moving of the diverging legs functions in holding together the dipping container and the plate.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed as being new and desired to be protected by Letters Patent of the United States is as follows:

1. A multi functional system including a plate (100) and a beverage container (200) and a dipping container (400), the system consisting of:

the plate (100) formed with a top having a radial exterior upper surface (109), the radially exterior upper surface having a periphery in an annular configuration, the plate formed with a centrally located circular aperture (101), the plate formed with a bottom having an annular lower surface (110) located radially between the upper surface and the circular aperture, the lower surface having upstanding side walls (111), (112) creating a frusta-conical cross sectional configuration surrounding the central aperture, the lower surface and upstanding side walls forming food-receiving regions, segmenting walls (105) extending radially between the side walls separating the food-receiving regions into separate sections, a first connector (113) formed in an inverted V-shaped configuration between the food-receiving regions and the circular aperture, the first connector having a first leg and a second leg and a downwardly facing channel (10) there between, the first leg being in a planar configuration at an acute negative angle with respect to a vertical bisector between the first and second legs, the second leg being formed with an annular concave recess (103) and an annular convex recess (107) the first connector being fabricated integrally with the food receiving regions;

the beverage container (200) formed with a closed bottom and an open top and a cylindrical side wall, the beverage container adapted to removably receive a beverage, a second connector (202) formed with an inverted J-shaped configuration fabricated integrally with the open top of the beverage container, the second connector being inserted upwardly into the first connector, four circumferentially spaced male attachment members (107) projecting inwardly from the second connector, the four circumferentially spaced male attachment members (201*a*), (201*b*), (201*c*), (201*d*) removably positional in the concave annular recess facilitating separable coupling the beverage container and the plate, the bottom of the beverage container extending beneath the plate to facilitate handling, the plate configured to receive the beverage container by movement of the beverage container into the channel (106); and the dipping container (400) formed with a closed bottom and an open top cylindrical and a side wall, the dipping container adapted to container a consumable dip, a third inverted connector (402) formed integrally with the open top of the dipping container, the third connector formed in an inverted L-shaped configuration with an angled single leg and an upper ledge, toe upper ledge being positional over the first inverted V-shaped connector facilitating coupling the dipping container to the plate due to gravity, the angled single leg having three circumferentially spaced male attachment members (403) projecting outwardly from the third connector, the three circumferentially male attachment members positional in the convex annular convex recess (107) to facilitate removable coupling of the dipping container to the plate, the concave recess (103) and the convex recess (107) being closely spaced elevationally to form an S-shaped cross sectional Configuration whereby the first V-shaped connector having diverging legs adapted to move together towards and away from an imaginary vertical center line upon the application of an outside force and to return to a rest position upon removal of the outside force, moving of the diverging legs functioning in holding together the beverage container and the plate, moving of the diverging legs functioning in holding together the dipping container and the plate.

* * * * *